US007377668B2

(12) United States Patent
Shemitz et al.

(10) Patent No.: US 7,377,668 B2
(45) Date of Patent: May 27, 2008

(54) ACCENT LIGHT

(75) Inventors: Sylvan R. Shemitz, Woodbridge, CT (US); Paul R. Ford, Orange, CT (US); Long Dam Quang, Hamden, CT (US)

(73) Assignee: Sylvan R. Shemitz Designs, Inc., West Haven, CT (US)

( * ) Notice: Subject to any disclaimer, the term of this patent is extended or adjusted under 35 U.S.C. 154(b) by 5 days.

(21) Appl. No.: 10/384,378

(22) Filed: Mar. 5, 2003

(65) Prior Publication Data

US 2003/0231500 A1 Dec. 18, 2003

Related U.S. Application Data

(63) Continuation-in-part of application No. 10/174,211, filed on Jun. 17, 2002, now Pat. No. 6,808,285.

(51) Int. Cl.
*F21S 4/00* (2006.01)
*H05B 33/02* (2006.01)
*F21V 21/00* (2006.01)

(52) U.S. Cl. ..... 362/225; 362/260; 362/250; 362/396; 362/370; 362/220; 362/217; 362/249; 362/223

(58) Field of Classification Search ..... 362/260, 362/228, 250, 252, 225, 396, 370, 371, 426, 362/220, 217, 249, 223, 145, 147, 148, 150
See application file for complete search history.

(56) References Cited

U.S. PATENT DOCUMENTS 4,569,568 A * 2/1986 Agabekov ..... 438/638
4,591,957 A * 5/1986 Harwood ..... 362/148
4,727,460 A * 2/1988 Payne ..... 362/269
4,760,507 A * 7/1988 Lasker et al. ..... 362/239
4,858,088 A * 8/1989 Agabekov ..... 362/249
4,876,633 A * 10/1989 Engel ..... 362/223
5,025,355 A * 6/1991 Harwood ..... 362/147
5,203,626 A * 4/1993 Clement ..... 362/250
5,584,576 A * 12/1996 Wei Hong ..... 362/396
6,220,721 B1 * 4/2001 Chan et al. ..... 362/219
6,416,207 B1 * 7/2002 Chang ..... 362/419
6,629,771 B2 * 10/2003 Chiu ..... 362/368

OTHER PUBLICATIONS

"Hospital Light" catalog pages, Linear Lighting Corp., Long Island City, New York (Mar. 1995).
"StyleLite" catalog pages, Linear Lighting Corp., Long Island City, New York (Mar. 1995).
"FLAP Lighting System" catalog pages, Artemide Inc., Farmingdale, New York (1998).
"M100" catalog pages, SELUX Corp., Highland, New York (2001).
"ERCO Indoor Lighting" catalog pages, ERCO Leuchten GmbH, Germany (2002).
"Mobile Leuchte" catalog page, Lam Lighting Systems, Santa Ana, California, undated.

* cited by examiner

*Primary Examiner*—Jacob Y. Choi
(74) *Attorney, Agent, or Firm*—Cantor Colburn LLP

(57) ABSTRACT

An accent light is provided that easily mounts directly to a linear luminaire across its light-emitting opening and in front of the luminaire's lamp(s). The accent light has one or more mounting devices that easily engage the luminaire. The accent light can be advantageously installed without disrupting a continuous row of linear luminaires.

54 Claims, 15 Drawing Sheets

ACCENT LIGHT

CROSS REFERENCE TO RELATED APPLICATION

This is a continuation-in-part of commonly assigned U.S. Pat. application Ser. No. 10/174,211, filed Jun. 17, 2002, now U.S. Pat. No. 6,808,285, which is incorporated by reference herein in its entirety.

BACKGROUND OF THE INVENTION

This invention relates to accent lights. More particularly, this invention relates to accent lights used with linear fluorescent luminaires.

Linear fluorescent luminaires are commonly arranged in continuous rows to provide a uniform "wash" of light on surfaces, objects, display areas, or work areas. Often, increased light levels or a change in light color is desired for particular surfaces, objects, or areas. An accent light is typically used to provide such lighting.

In known lighting systems, an accent light is usually installed separate from the fluorescent luminaire units. For example, an accent light is often installed between two fluorescent luminaire units. This, however, causes a break in a continuous row of fluorescent luminaires. Moreover, an arrangement of alternating fluorescent and accent lighting units typically increases the number of parts and suspension points on the row, resulting in higher equipment costs and higher installation costs.

Known accent lights are also arranged in various other ways across a ceiling separate from the fluorescent units. For example, accent lights may be arranged along one or more ceiling edges or in rows perpendicular to the fluorescent units. These arrangements also result in higher equipment and installation costs because separate wiring and hardware are required for the accent lights.

In other known lighting systems, accent lights . hang from pendants or other extension hardware attached to either the fluorescent units, the ceiling, or other structure. Such systems may not be practical in low-ceiling applications, nor may they be aesthetically pleasing in applications. where clean, uncluttered appearances are desired.

In still other known lighting systems, luminaire units are provided with fluorescent uplighting and accent downlighting. Such units, however, are inadequate for applications that require general fluorescent downlighting in addition to accent lighting.

In view of the foregoing, it would be desirable to be able to provide an accent light that mounts directly to a linear fluorescent luminaire such that both downlighting and accent lighting are provided without disrupting a continuous row of linear fluorescent luminaires.

It would also be desirable to be able to provide an accent light that easily mounts with or without tools or additional mounting hardware directly to a linear fluorescent luminaire.

SUMMARY OF THE INVENTION

It is an object of this invention to provide an accent light that mounts directly to a linear fluorescent luminaire such that both downlighting and accent lighting are provided without disrupting a continuous row of linear fluorescent luminaires.

It is also an object of this invention to provide an accent light that easily mounts with or without tools or additional mounting hardware directly to a linear fluorescent luminaire.

In accordance with the invention, an accent light is provided that easily mounts with or without tools or additional mounting hardware directly to a linear fluorescent luminaire. The mounting of the accent light does not disrupt a continuous row of such linear fluorescent luminaires and advantageously provides accent lighting along with fluorescent downlighting. The accent light preferably has first and second mounting devices, although a single mounting device can be alternatively used. The first and second mounting devices easily engage preferably upper and lower portions, respectively, of a linear luminaire such that the accent lamp is positioned directly in front of and adjacent to the luminaire's lamp(s). The accent light preferably can be adjusted to aim accent lamp light in preferably each of two directions in preferably each of two dimensions. For example, the accent light preferably can be adjusted to aim light preferably left and right and preferably up and down as desired. In alternative embodiments, the accent light need not be adjustable. Accent lamps used with the invention are preferably MR-16 or MR-11 tungsten halogen reflector lamps, but other types of lamps also can be used.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
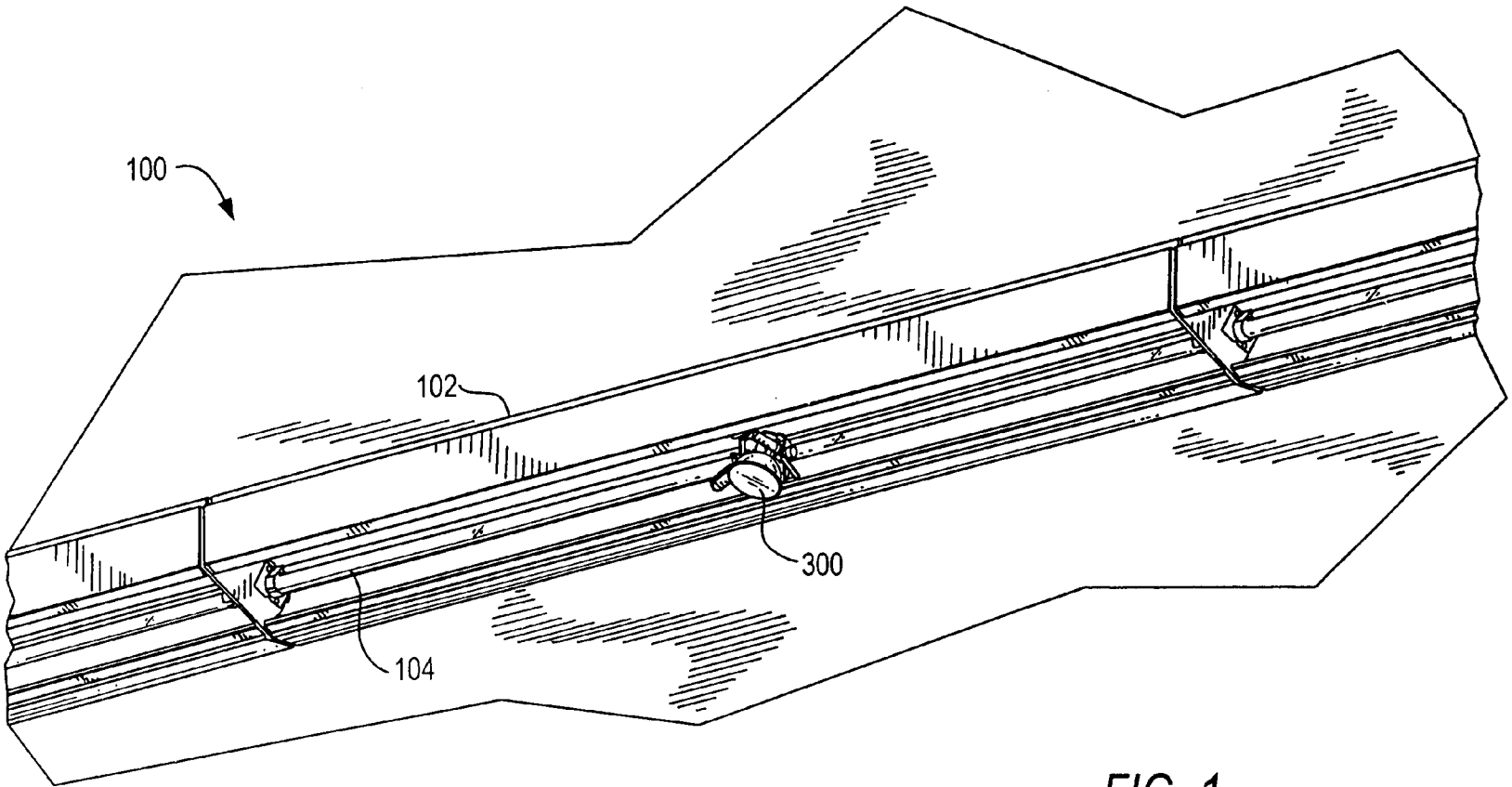
FIG. 1 is a perspective view of a lighting system having an accent light attached to a surface-mounted linear fluorescent luminaire according to the invention.

FIG. 1 shows lighting system 100 in accordance with the invention. System 100 includes an accent light 300 mounted to a preferably linear fluorescent luminaire 102. Luminaire 102 is surface mounted and can be arranged in a continuous row of luminaires, as shown. Accent light 300 is mounted laterally across luminaire 102 such that it is directly in front of fluorescent lamp 104. This arrangement advantageously avoids an interruption in a continuous row of luminaires, and maintains a clean, uncluttered appearance not generally possible with accent lights hanging down from pendants or other hardware. Although shown mounted generally in the middle of luminaire 102, accent light 300 can be mounted anywhere along the longitudinal length of luminaire 102.

Accent light 300 is not limited to use with surface mounted luminaires. As shown in lighting system 200 of FIG. 2, accent light 300 can also be mounted to a semi-recessed or fully-recessed mounted linear fluorescent luminaire 202 arranged in a continuous row of such luminaires.

Figure 2:
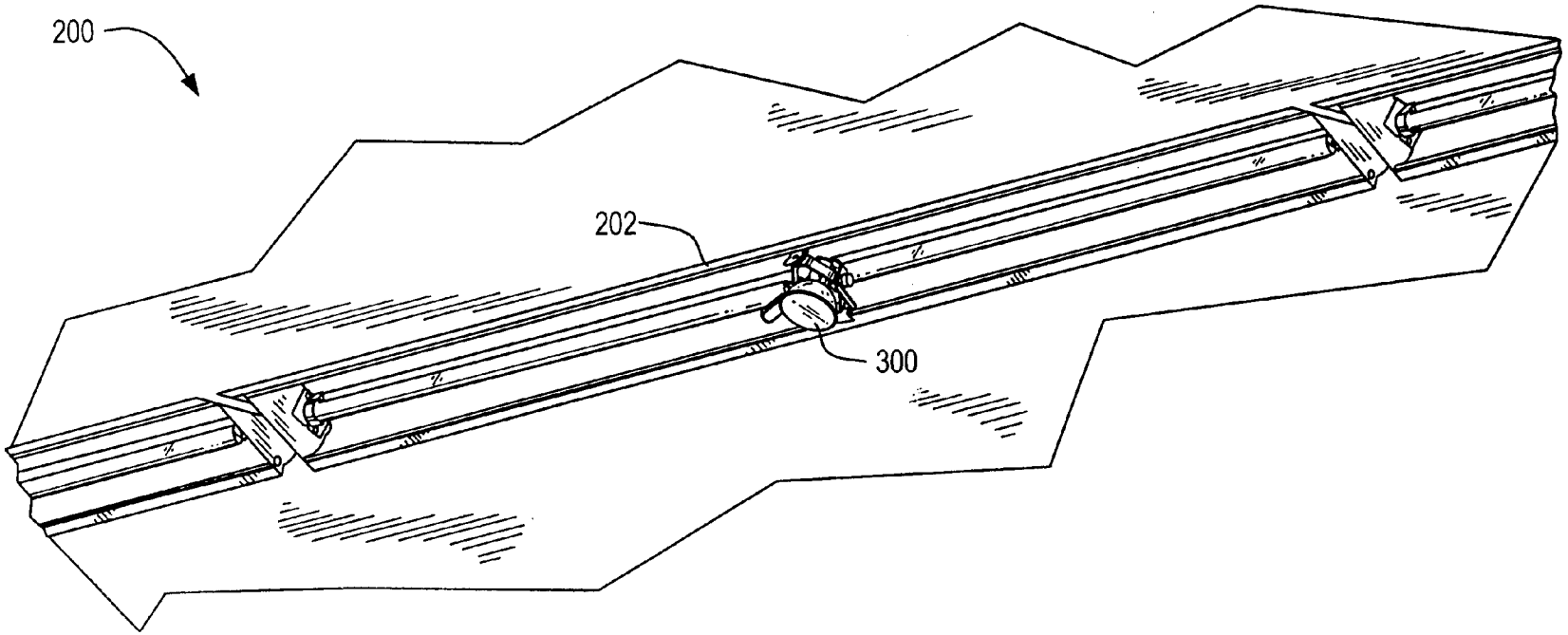
FIG. 2 is a perspective view of another lighting system having an accent light attached to a recessed-mounted linear fluorescent luminaire according to the invention.
Figure 3:
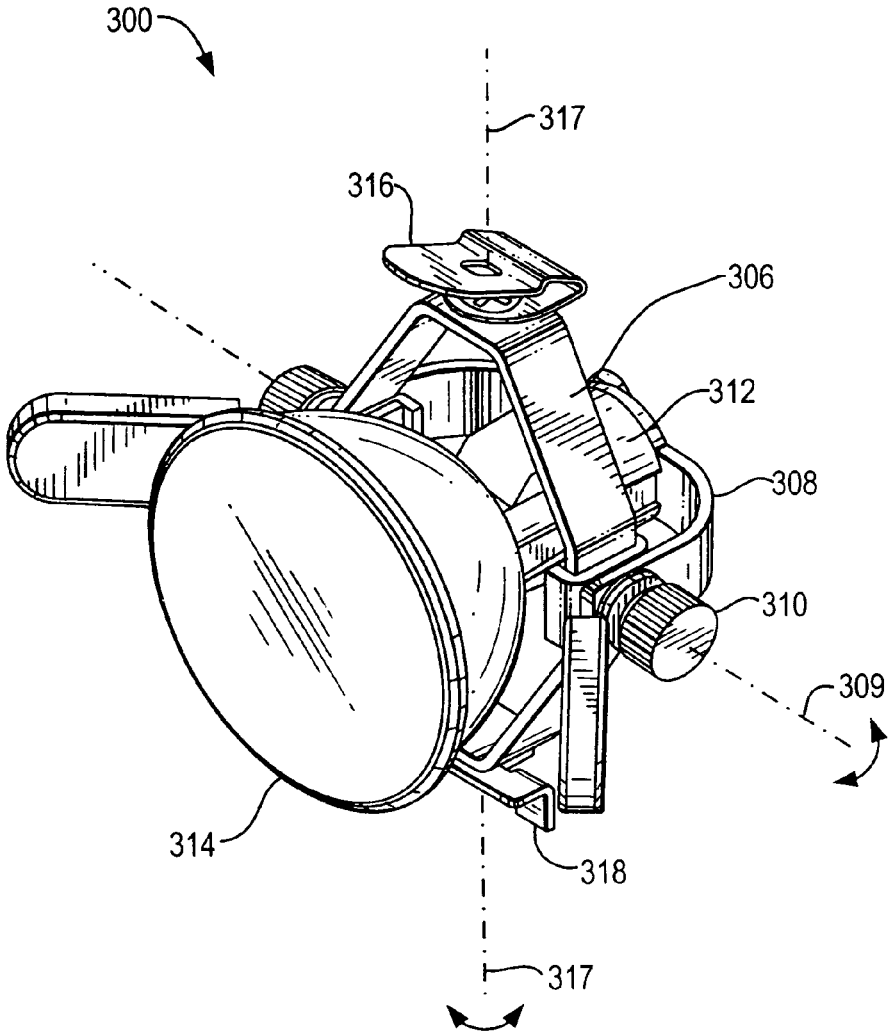
FIG. 3 is a perspective view of an accent light according to the invention.
Figure 4:
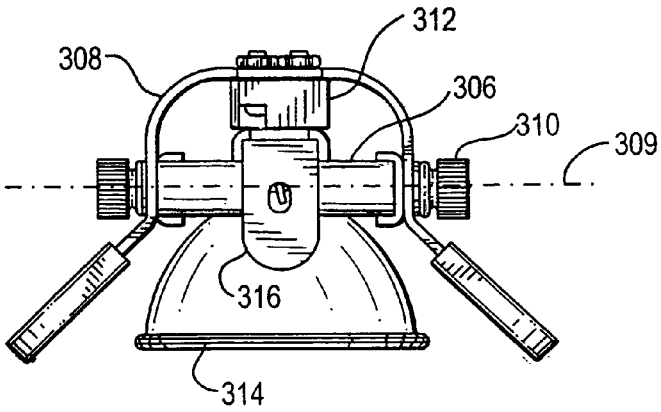
FIGS. 4-6 are top, front, and side views, respectively, of the accent light of FIG. 3.
Figure 5:
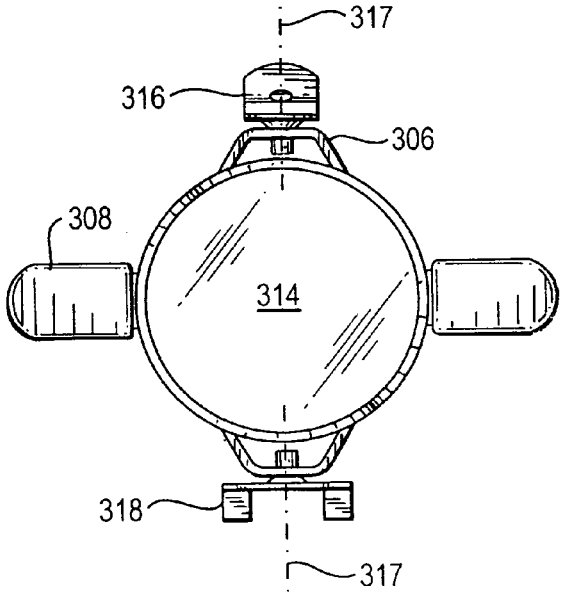
Figure 6:
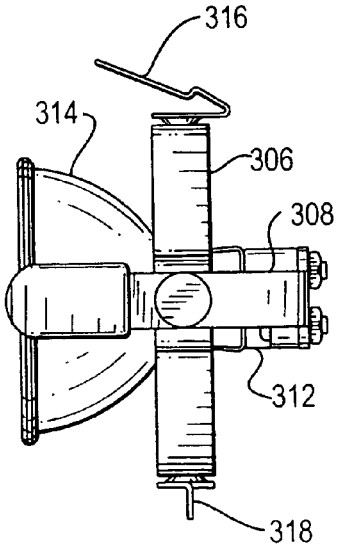
Figure 9:
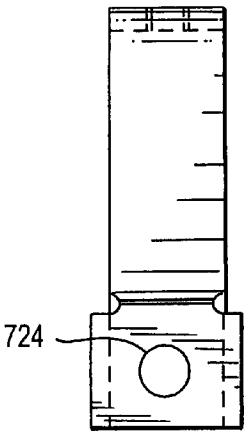
FIGS. 7-10 are left side, front, right side, and bottom views, respectively, of an embodiment of a portion of a frame of an accent light according to the invention.
Figure 8:
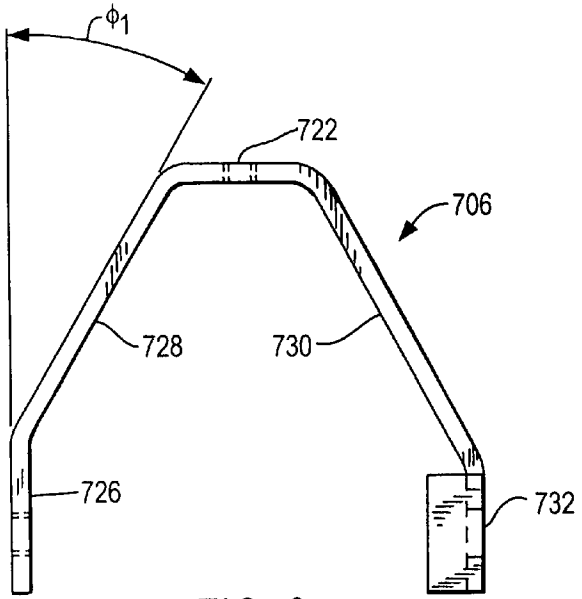
Figure 10:
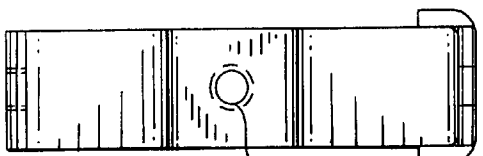
Figure 7:
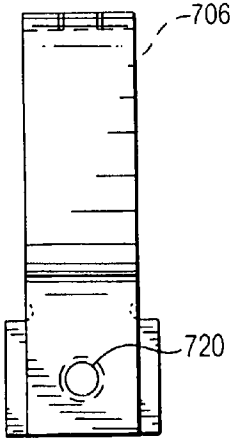

Although only one accent light 300 is shown attached to luminaires 102 and 202 in FIGS. 1 and 2, respectively, more than one accent light 300 can be attached to a single luminaire in accordance with the invention. Moreover, accent light 300 can be used with luminaires having fixed or adjustable reflectors.

Accent light 300 is also not limited to use with just fluorescent luminaires, but alternatively can be mounted to other types of linear luminaires that provide other than fluorescent lighting.

FIGS. 3-6 illustrate an exemplary embodiment of an accent light in accordance with the invention. Accent light 300 preferably includes a frame 306, a yoke 308, a locking screw 310, a lampholder or lamp socket 312, a lamp 314, an upper mounting device 316, and a lower mounting device 318. Lampholder/socket 312 is preferably attached to yoke 308 and is sized to receive preferably either a low voltage MR-16 or MR-11 tungsten halogen lamp. Alternatively, lampholder/socket 312 can be of a size to receive other types and sizes of lamps that can be used to provide accent or other types of lighting (e.g., flood lighting). Yoke 308 is attached to frame 306 such that yoke 308 is preferably rotatable about an axis 309 to provide up and down light aiming adjustments. Locking screw 310 is preferably provided to lock yoke 308 in a desired up/down position. Frame 306 is preferably rotatable about axis 317 to provide left and right aiming adjustments. Frame 306, yoke 308, upper mounting device 316, and lower mounting device 318 are described in more detail below.

Note that although frame 306, yoke 308, upper mounting device 316, and lower mounting device 318 are each shown and described as separate components attached to each other, in other embodiments of the invention, frame 306 may be a single unit that includes one or more of yoke 308, upper mounting device 316, and lower mounting device 318 as integral parts.

FIGS. 7-10 illustrate an embodiment of a portion of frame 306 in accordance with the invention. In this embodiment, portion 706 represents half of frame 306. Frame portion 706 has holes 720, 722, and 724. Holes 720 and 724 facilitate the attachment of yoke 308 and preferably locking screw 310 to frame 306. Holes 720 and 724 also facilitate the attachment of one or more other portions of frame 306 to portion 706 (an embodiment of which is described below with respect to FIG. 12). Hole 722 facilitates the attachment of upper mounting device 316 to frame 306. Preferably, that attachment allows frame 306 to rotate while upper mounting device 316 remains stationary. Angle Ø1 formed by segments 726 and 728 is preferably about 30°, although it can be other angles as well. Frame portion 706 is preferably symmetrically shaped, and thus the corresponding angle formed by segments 730 and 732 is also preferably about 30°. Alternatively, frame portion 706 need not be symmetrically shaped, nor does the corresponding angle formed by segments 730 and 732 need to be about 30°.

Figure 11:
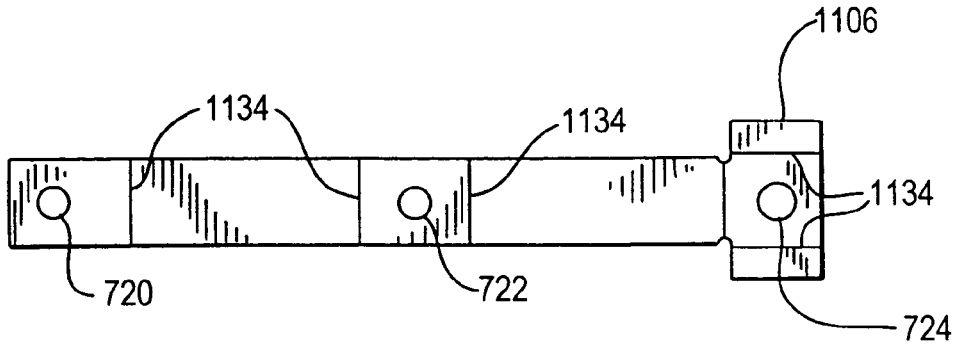
FIG. 11 is a top view of a workpiece that can be used to form a portion of the frame of FIGS. 7-10.

Advantageously, frame portion 706 can be fabricated from a single workpiece as shown in FIG. 11. Workpiece 1106 is preferably a stainless steel or other suitable metal. Frame portion 706 can be formed into the appropriate shape as shown in FIGS. 7-10 by bending workpiece 1106 along bend lines 1134.

Frame portion 706 may instead be a suitable plastic fabricated into the shape shown in FIGS. 7-10.

Figure 12:
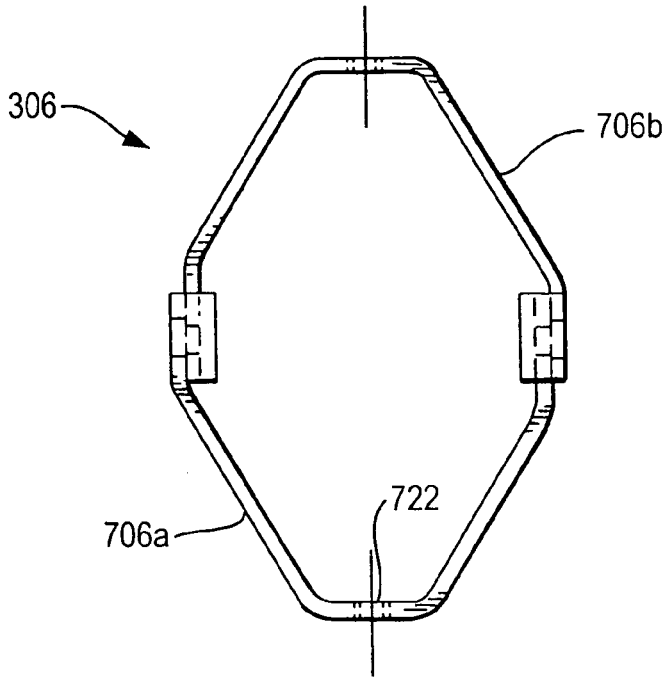
FIG. 12 is a front view of an embodiment of the frame comprised of two of the frame portions of FIGS. 7-10 according to the invention.
Figure 14:
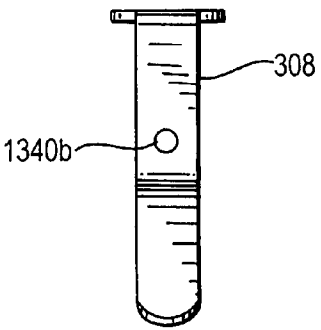
FIGS. 13-16 are perspective, side, top, and front views, respectively, of an embodiment of a yoke of an accent light according to the invention.
Figure 16:
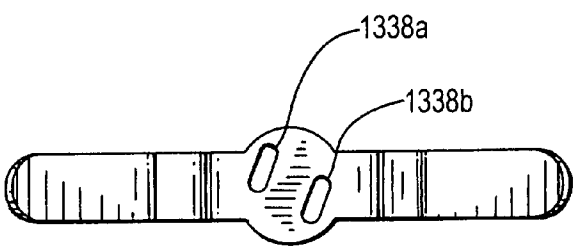
Figure 13:
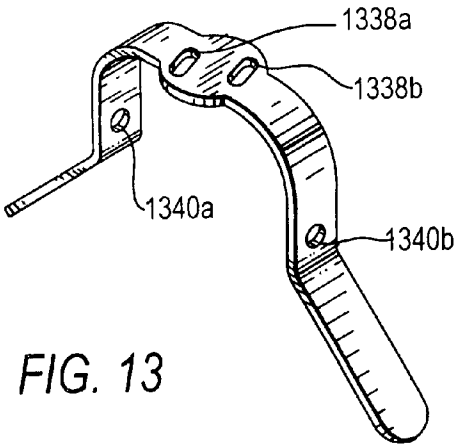
Figure 15:
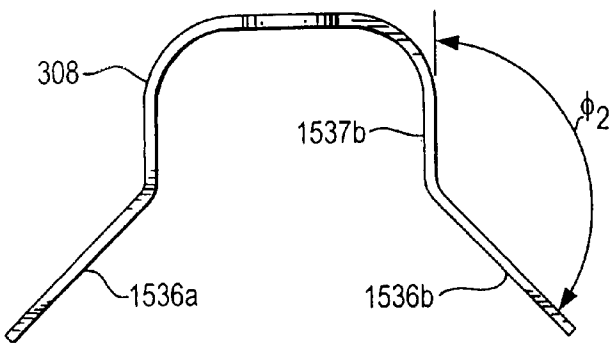
Figure 18:
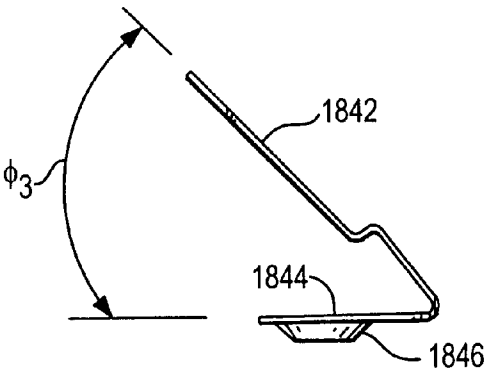
FIGS. 17-20 are perspective, side, back, and bottom views, respectively, of an embodiment of a first mounting device of an accent light according to the invention.
Figure 20:
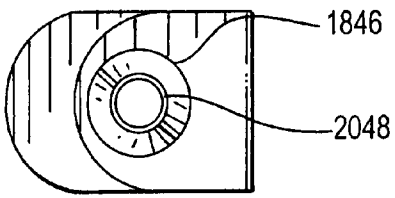
Figure 17:
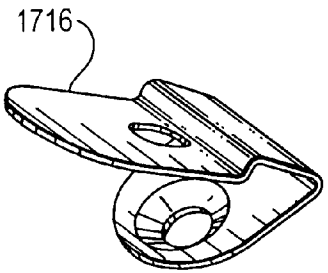
Figure 19:
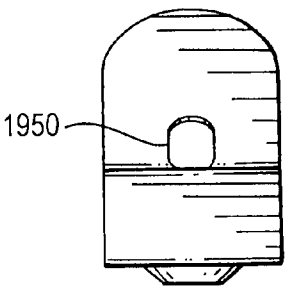
Figure 22:
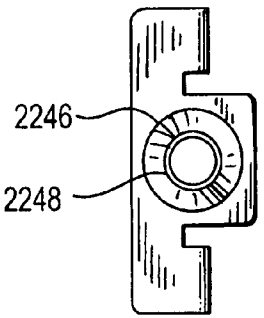
FIGS. 21-24 are perspective, top, front, and side views, respectively, of an embodiment of a second mounting device of an accent light according to the invention.
Figure 24:
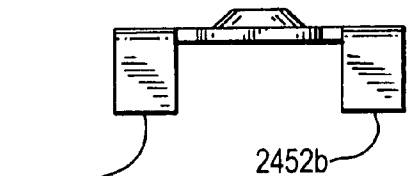
Figure 21:
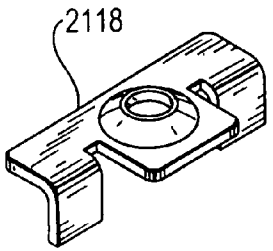
Figure 23:
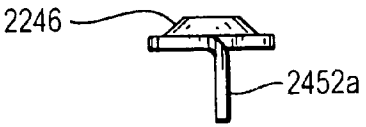

In accordance with the invention, two identical frame portions 706*a, b* can be assembled to form frame 306 as shown in FIG. 12. Note that frame portions 706*a, b* are inverted with respect to each other. Thus, hole 722 of frame portion 706*a* facilitates the attachment of lower mounting device 318 to frame 306. Preferably, that attachment allows frame 306 to rotate while lower mounting device 318 remains stationary. Note further that frame 306 is preferably symmetrically shaped, although alternatively it need not be.

Although shown as two pieces, frame 306 may instead be fabricated as a single piece, and alternatively may be made of a suitable plastic.

FIGS. 13-16 illustrate an embodiment of yoke 308 in accordance with the invention. Yoke 308 is a generally U-shaped structure having segments 1536*a, b* extending outward. Yoke 308 is also preferably symmetrically shaped in which angle Ø2 formed by segments 1536*b* and 1537*b* is preferably about 135°, although in other embodiments angle Ø2 can be of other values. Yoke 308 is preferably a stainless steel or other suitable metal or material (e.g., plastic). Yoke 308 has a pair of holes 1338*a, b* to facilitate attachment of lampholder/socket 312 thereto as well as to preferably facilitate power connections to lampholder/socket 312. Yoke 308 also has another pair of holes 1340*a, b* to facilitate attachment of yoke 308 to frame 306. Preferably, yoke 308 rotates about axis 309 and holes 1340*a* b further facilitate attachment of locking screw 310 to yoke 308.

FIGS. 17-20 illustrate an embodiment of an upper mounting device in accordance with the invention. Upper mounting device 316 is preferably a spring clip. Spring clip 1716 is preferably a stainless steel or other suitable metal or material (e.g., plastic). Spring clip 1716 has upper and lower portions 1842 and 1844 forming a resting angle Ø3 (i.e., portions 1842 and 1844 are not stressed) of preferably about 45°. In other embodiments of spring clip 1716, angle Ø3 can be of other values. Spring clip 1716 also has an embossment or boss 1846 and hole 2048 there through to facilitate attachment of spring clip 1716 to frame 306 and preferably to facilitate rotation of frame 306 about axis 317 while spring clip 1716 remains stationary. Spring clip 1716 further has hole 1950 to provide access to a fastener (e.g., a screw) used with hole 2048 to attach clip 1716 to frame 306.

FIGS. 21-24 illustrate an embodiment of a lower mounting device in accordance with the invention. Lower mounting device 318 is preferably a clip. Clip 2118 is preferably a stainless steel or other suitable metal or material (e.g., plastic). Clip 2118 has an embossment or boss 2246 and hole 2248 there through to facilitate attachment of clip 2118 to frame 306 and preferably to facilitate rotation of frame 306 about axis 317 while clip 2118 remains stationary. Clip 2118 also has preferably two extensions 2452*a, b* extending below boss 2246 and hole 2248 for engaging a luminaire as described with respect to FIGS. 25 and 26.

Various fasteners can be used to attach upper and lower mounting devices to frame 306 in accordance with the invention. Thus, the invention is not limited to any one fastener, type of fastener, or method of attaching the mounting devices to the frame.

Figure 25:
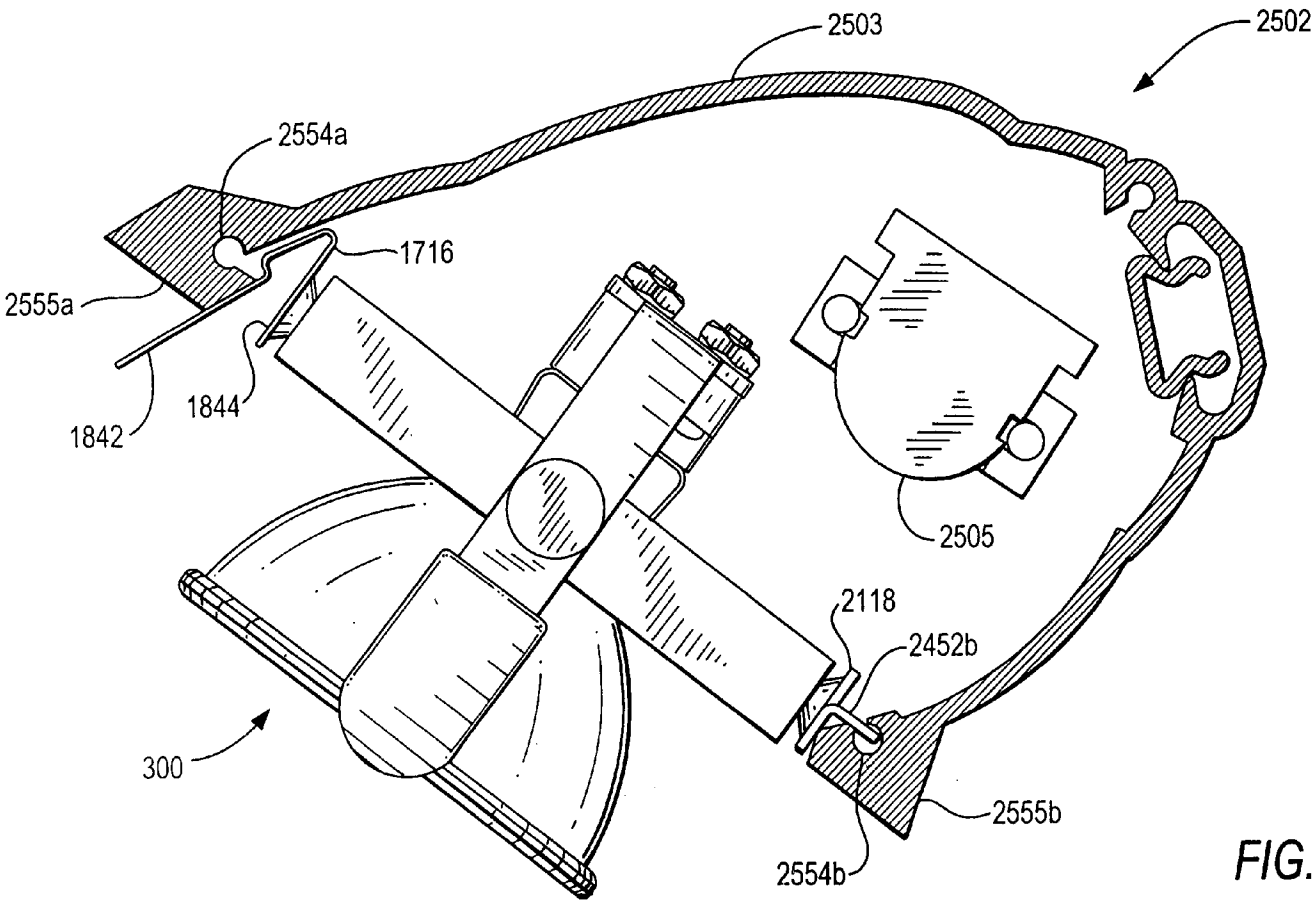
FIG. 25 is a simplified side view of an accent light mounted to a luminaire reflector according to the invention.

FIG. 25 illustrates accent light 300 mounted to a reflector 2503 of a luminaire 2502 in accordance with the invention. Luminaire 2502 is preferably a linear fluorescent luminaire, although it need not be a fluorescent luminaire. Luminaire 2502 includes a lampholder 2505, which is operative to hold and provide power to a preferably fluorescent lamp. Reflector 2503 preferably has respective screwports or screwtracks 2554*a, b* running preferably substantially along the entire longitudinal length of upper edge 2555*a* and lower edge 2555*b* of reflector 2503. Note, however, that other embodiments of luminaires need not have screwports 2554*a, b* in accordance with the invention.

Accent light 300 is mounted to luminaire 2502 preferably as follows: lower mounting device 2118 first engages a lower portion, preferably the lower edge, of reflector 2503 such that extensions 2452*a, b* are inserted into screwport 2554*b*. Upper mounting device 1716 then engages an upper portion, preferably the upper edge, of reflector 2503. This presses upper portion 1842 toward lower portion 1844 of upper mounting device 1716, resulting in a spring force against luminaire 2502 that holds accent light 300 in place. Accordingly, accent light 300 is advantageously mounted without tools or additional mounting hardware. Note that upper mounting device 1716 is positioned over screwport 2554*a* and thus does not require that reflector 2503 have such a screwport. Upper mounting device 1716 can advantageously engage, for example, a groove, slot, track, boss, indentation, or flat surface. As shown, accent light 300 is mounted laterally across luminaire 2502 (i.e., across the light-emitting opening of luminaire 2502 and reflector 2503) such that a lamp held by lampholder 2505 is located behind accent light 300. Note that in some embodiments, the accent light can be mounted to a luminaire both as shown and upside down. That is, upper mounting device 1716 can alternatively engage a lower portion of the luminaire while lower mounting device 2118 can engage an upper portion of the luminaire.

Figure 26:
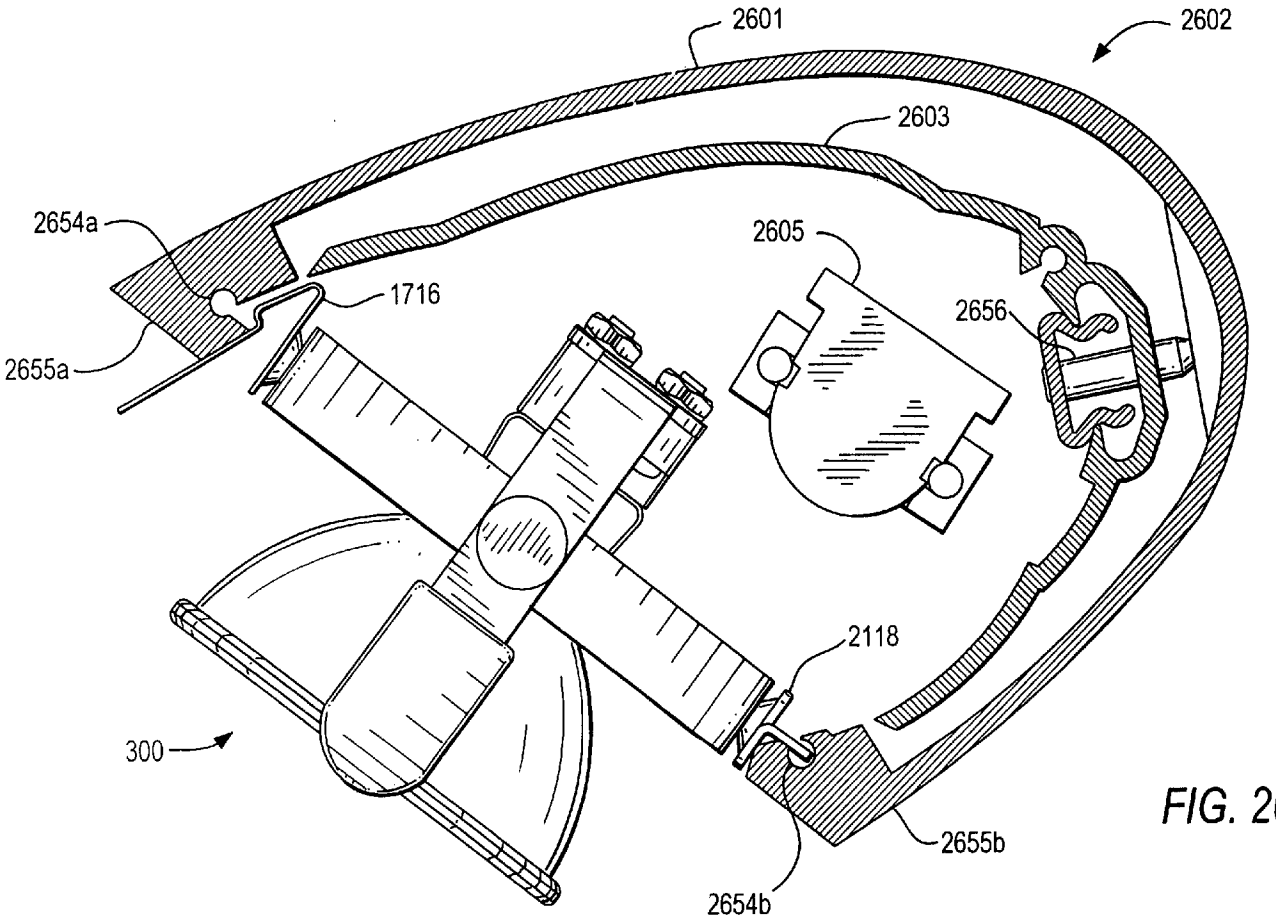
FIG. 26 is a simplified side view of an accent light mounted to a luminaire housing according to the invention.

Advantageously, accent light 300 is not limited to mountings on a luminaire reflector. For example, accent light 300 can be mounted to the housing of a luminaire, as shown in FIG. 26. Luminaire 2602 includes housing 2601, reflector 2603, and lampholder 2605. Reflector 2603 is attached to housing 2601 via fastener 2656 (note that reflector 2603 can be attached to housing 2601 in many alternative ways, including, for example, attachment to endplates (not shown) which are attached to or are a part of housing 2601). Housing 2601 preferably has respective screwports or screwtracks 2654*a, b* running preferably substantially along the entire longitudinal length of upper edge 2655*a* and lower edge 2655*b* of housing 2601. Note, however, that other embodiments of luminaire 2602 need not have screwports 2654*a, b* in accordance with the invention. Accent light 300 mounts to luminaire 2602 in the same manner as it did for luminaire 2502 except that upper and lower mounting devices 1716 and 2118, respectively, engage housing 2601 instead of reflector 2603.

Figure 27:
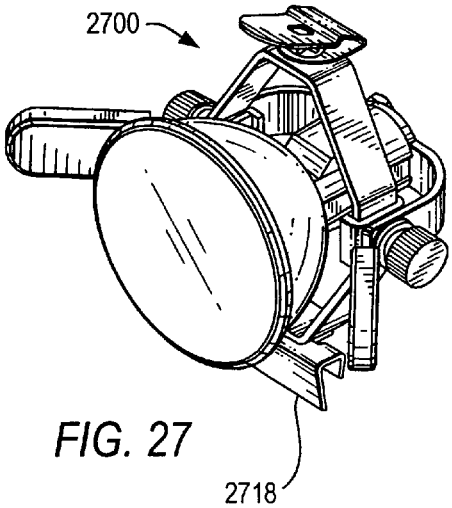
FIGS. 27-29 are perspective, front, and side views, respectively, of an accent light having another embodiment of a mounting device according to the invention.
Figure 28:
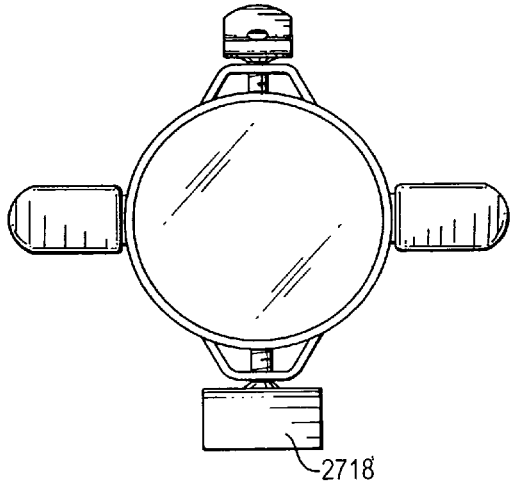
Figure 29:
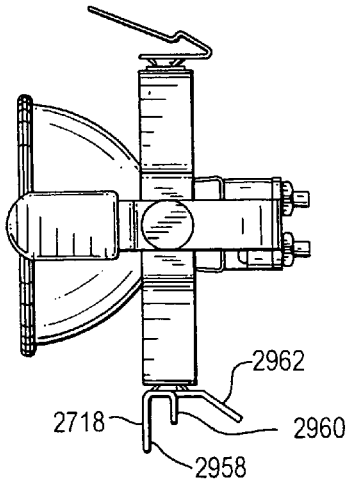

As mentioned above, luminaires need not have screwports in accordance with the invention. FIGS. 27-29 illustrate accent light 2700 having another embodiment of a lower mounting device. Accent light 2700 can be similar or identical to accent light 300 except for lower mounting device 2718. Lower mounting device 2718 has three sections 2958, 2960, and 2962. Accent light 2700 preferably mounts to a luminaire in the same manner as described above, except that sections 2958 and 2960 preferably fit over an edge of the luminaire. That edge can be either the edge of a reflector, housing, or other part of the luminaire. Lower mounting device 2718 thus does not require a screwport. Section 2962 is optional and can be used, for example, to retain wiring running along the same edge of the luminaire to which lower mounting device 2718 is engaged, as shown in FIG. 30.

Figure 30:
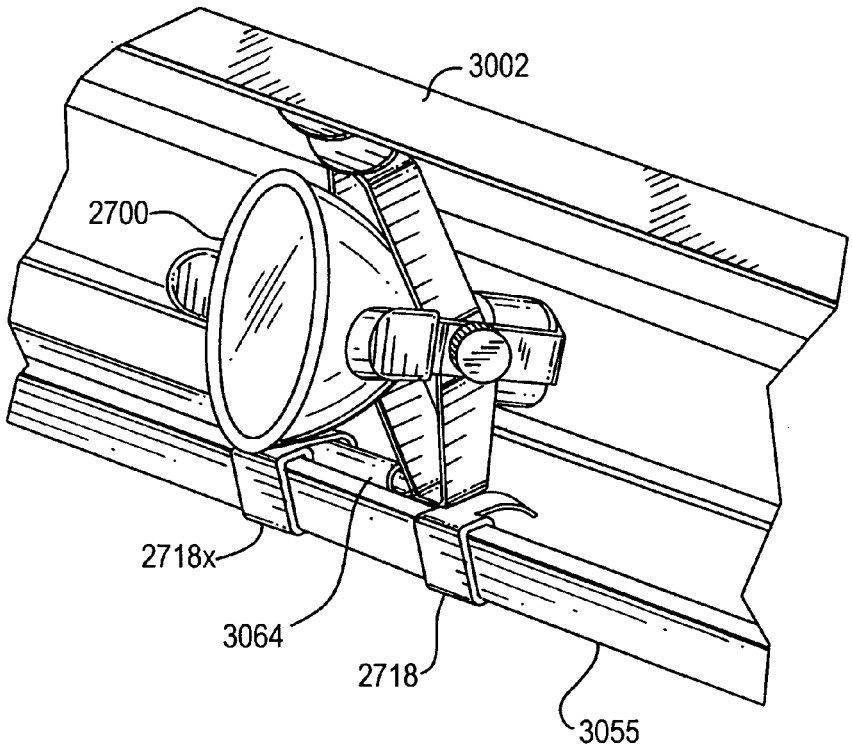
FIG. 30 is a perspective view of an accent light mounted to a linear fluorescent luminaire having wiring running there through according to the invention.

FIG. 30 shows accent light 2700 mounted to a luminaire 3002. In particular, mounting device 2718 is mounted over lower edge 3055 of luminaire 3002. Luminaire 3002 has wiring conduit 3064 running along the inside of its lower edge 3055. Wiring conduit 3064 preferably carries power conductors (e.g., electrical wiring) that can be coupled to accent light 2700. Advantageously, if the power conductors carried by wiring conduit 3064 are on a separate circuit or switch, accent light 2700 can be controlled separately from luminaire 3002. Conduit 3064 is preferably held in place between sections 2960 and 2962 of lower mounting device 2718. Note that, as shown, a separate, stand-alone mounting device 2718*x* can be advantageously used to hold conduit 3064 in place along edge 3055.

Upper and lower mounting devices of the invention can be sized and dimensioned alternatively to those shown and described herein in order to engage various other types of linear luminaires or linear luminaire portions or edges in accordance with the invention. Thus, upper and lower mounting devices that engage luminaires differently than those shown and described herein are also within the scope of the invention. For example, upper and lower mounting devices that require one or more fasteners, additional mounting hardware, or one or more tools in order to attach the accent light across a luminaire are still within the scope of the invention. Furthermore, other embodiments of accent lights can have identical upper and lower mounting devices in accordance with the invention. For example, an accent light can have upper and lower mounting devices that are similar or identical to mounting device 1716 or that each require a set-screw with which to engage the luminaire.

Figure 31:
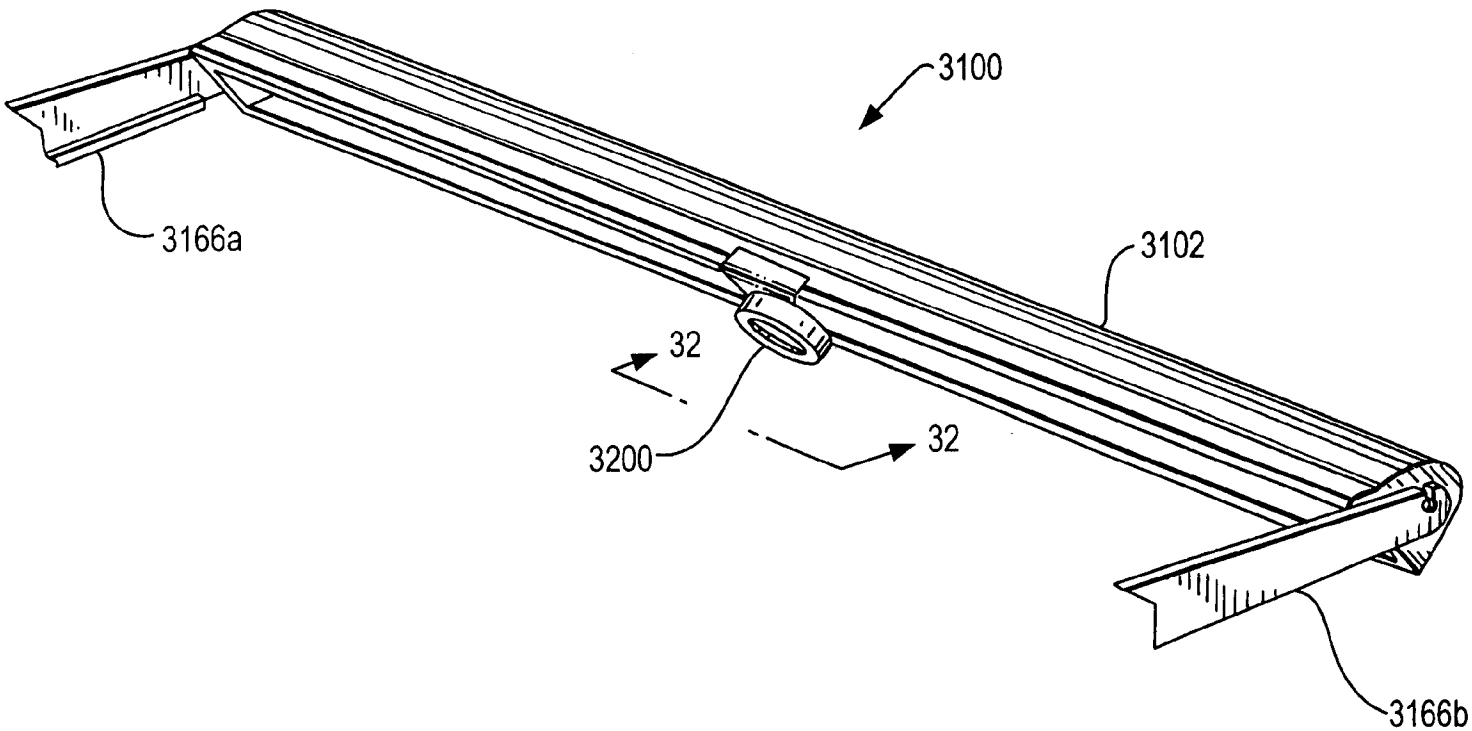
FIG. 31 is a perspective view of still another lighting system having an accent light attached to a cantilevered linear fluorescent luminaire according to the invention.
Figure 32:
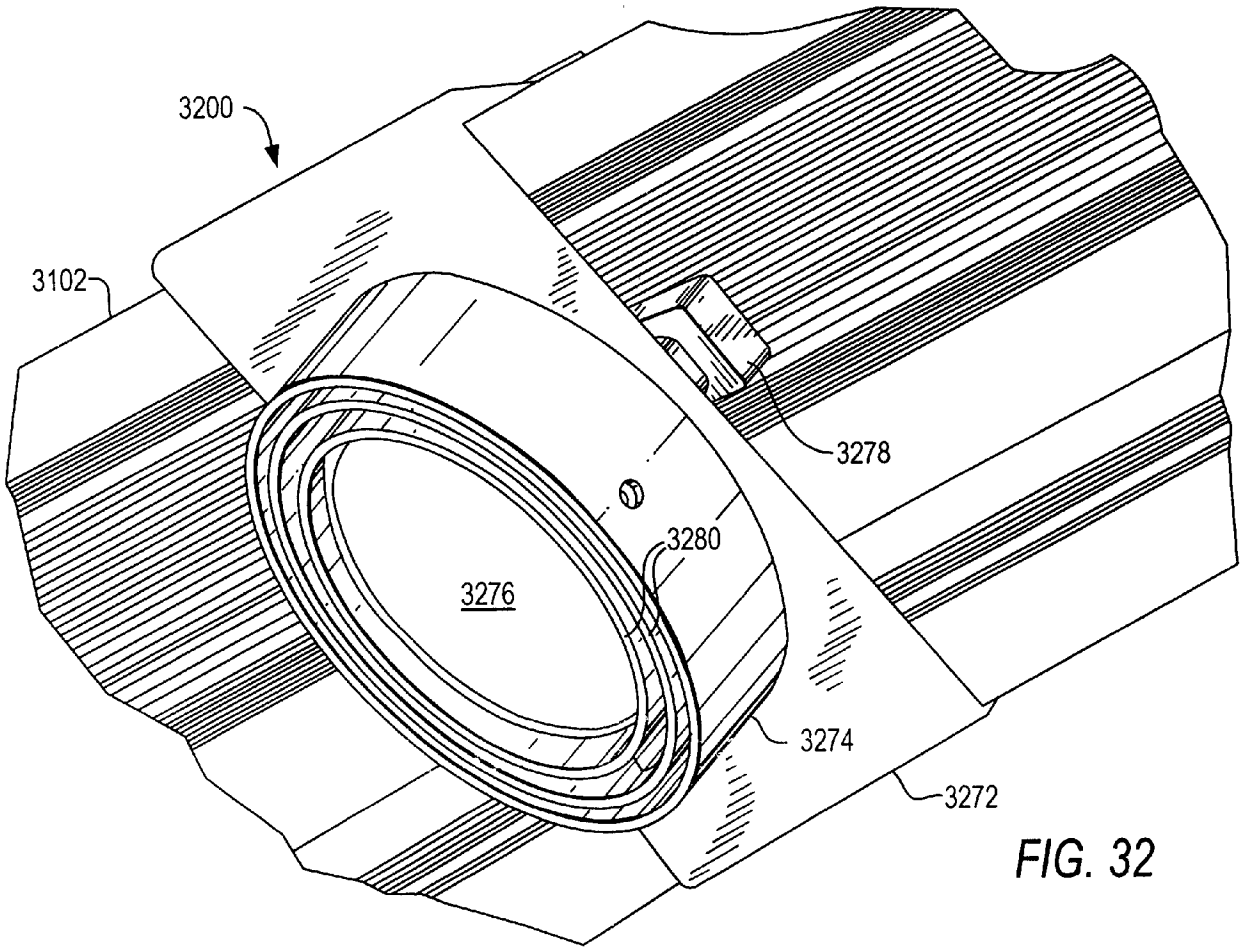
FIG. 32 is a perspective view of a portion of the luminaire of FIG. 31 taken from line 32-32 of FIG. 31.

FIG. 31 shows a lighting system 3100 in accordance with the invention. System 3100 includes a luminaire 3102 supported by a pair cantilever arms 3166*a, b*. System 3100 also includes another embodiment of an accent light in accordance with the invention. Accent light 3200 has a single mounting device instead of upper and lower mounting devices. This mounting device, better seen in FIG. 32, is preferably a stainless steel or other suitable metal or material (e.g., plastic) spring clip bracket 3272. Bracket 3272 clips on to luminaire 3102 across the light-emitting side of luminaire 3102. An accent light housing 3274 is attached to bracket 3272. Housing 3274 is preferably cylindrical, but alternatively can be of other shapes (e.g., rectangular, oval, hexagonal). Accent light 3200 also includes lampholder 3278 and preferably an MR-16 or MR-11 type lamp 3276 held by lampholder 3278. Alternatively, other types of lamps can be used. Lamp 3276 is preferably held in place by a gimbal-ring mechanism 3280 attached to housing 3274. Gimbal-ring mechanism 3280 permits lamp 3276 to pivot in more than one dimension. Alternatively, lamp 3276 can be fixedly held in place directly by housing 3274.

Advantageously, no tools or additional mounting hardware is required in preferred embodiments to mount accent lights of the invention to luminaires. These accent lights are therefore easily installed and easily removed (e.g., to access a fluorescent lamp). They are thus portable and can be readily moved from luminaire to luminaire as needed or desired.

Advantageously, accent lights of the invention eliminate the need for separate accent luminaire units. They can be added to a continuous row of fluorescent luminaires without breaking up the row and can be mounted anywhere along the length of the row. Accent lights of the invention are preferably fully adjustable (e.g., up/down and left/right) and may be sold separately as a sub-assembly with or without lamps.

Thus it is seen that accent lights are provided that easily attach to a linear luminaire, thus avoiding a disruption in a continuous row of such luminaires, while providing accent lighting in addition to a luminaire's downlighting. One skilled in the art will appreciate that the invention can be practiced by other than the described embodiments, which are presented for purposes of illustration and not of limitation, and the invention is limited only by the claims which follow.

We claim:

1. An accent light comprising:

a frame;

a lamp attached to said frame;

a first mounting device attached to said frame, said first mounting device dimensioned and shaped to directly engage a first portion of a luminaire, and a second mounting device attached to said frame, said second mounting device dimensioned and shaped to directly engage a second portion of said luminaire;

wherein said first portion of said luminaire and said second portion of said luminaire are disposed on opposite sides of an opening of the luminaire such that the accent light extends across said opening and across and directly in front of a linear lamp tube disposed in the luminaire opening; and wherein a portion of at least one of the frame, the first mounting device, and the second mounting device is disposed within the luminaire in the opening.

2. The accent light of claim 1 wherein said frame is rotatable about a first axis while said first and second mounting devices remain stationary.

3. The accent light of claim 1 wherein said frame is rotatable about a first axis aligned with said first and second mounting devices.

4. The accent light of claim 1 wherein said frame rotates left and right with respect to a first axis aligned with said first and second mounting devices.

5. The accent light of claim 1 wherein a portion of said frame to which said lampholder is attached is rotatable while said first and second mounting devices remain stationary.

6. The accent light of claim 1 wherein a portion of said frame to which said lampholder is attached is rotatable about a second axis.

7. The accent light of claim 1 wherein:

said frame comprises a yoke;

said lampholder is attached to said yoke; and said yoke is rotatable about a second axis.

8. The accent light of claim 1 wherein a portion of said frame rotates up and down with respect to a second axis perpendicular to a first axis aligned with said first and second mounting devices.

9. The accent light of claim 1 wherein said first mounting device is dimensioned and shaped to fit over one of a screwport, a slot, a track, a boss, an indentation, or a fiat surface of said first luminaire portion.

10. The accent light of claim 1 wherein said first mounting device is dimensioned and shaped to engage said first luminaire portion via a spring force.

11. The accent light of claim 1 wherein said first mounting device comprises a clip.

12. The accent light of claim 11 wherein said clip is a spring clip.

13. The accent light of claim 12 wherein said spring clip has a first portion and a second portion, said first clip portion attached to said frame and said second clip portion operative to engage said first luminaire portion, said first clip portion joined to said second clip portion at an angle of about 45° before engagement with said first luminaire portion.

14. The accent light of claim 1 wherein said first mounting device is dimensioned and shaped to engage a first edge of a housing of said luminaire.

15. The accent light of claim 1 wherein said second mounting device is dimensioned and shaped to fit over said second luminaire portion.

16. The accent light of claim 1 wherein said second mounting device is dimensioned and shaped to engage a one of a screwport, a slot, a track, a boss, an indentation, or a flat surface in said second luminaire portion.

17. The accent light of claim 1 wherein said second mounting device comprises a clip.

18. The accent light of claim 1 wherein said second mounting device is dimensioned and shaped to engage a second edge of said lummaire.

19. The accent light of claim 1 wherein said second mounting device is dimensioned and shaped to engage a second portion of a reflector of said luminaire.

20. The accent light of claim 1 wherein said second mounting device is dimensioned and shaped to engage a second portion of a housing of said luminaire.

21. The accent light of claim 1 wherein said second mounting device is dimensioned and shaped to engage a second edge of a housing of said luminaire.

22. The accent light of claim 1 wherein said lampholder is sized to receive a tungsten halogen lamp.

23. The accent light of claim 1 wherein said lampholder is sized to receive a low voltage tungsten halogen lamp.

24. A lighting system comprising:

a linear luminaire comprising:

a first lampholder operative to hold a lamp, and a reflector partially disposed about said lampholder, said luminaire having an opening through which light produced by said lamp is output; and an accent light mounted to said luminaire such that said accent light is positioned across said opening and across and directly in front of said lamp, said accent light comprising:

a frame, a second lampholder attached to said frame, a mounting device attached to said frame, said mounting device dimensioned and shaped to engage said luminaire;

wherein a portion of at least one of the frame and the mounting device is disposed within the luminaire in the opening.

25. The lighting system of claim 24 wherein said luminaire opening is longitudinal and said accent light is positioned laterally across said opening.

26. The lighting system of claim 24 wherein said first lampholder is operative to hold a fluorescent lamp.

27. The lighting system of claim 24 wherein said mounting device comprises a spring clip bracket.

28. The lighting system of claim 24 wherein said mounting device comprises a spring clip dimensioned and shaped to engage a first portion of said luminaire.

29. The lighting system of claim 24 wherein said accent light further comprises a second mounting device aff ached to said frame, said second mounting device dimensioned and shaped to engage a second portion of said luminaire.

30. The lighting system of claim 24 wherein:

said mounting device is dimensioned and shaped to engage a first portion of said reflector; and said accent light further comprises a second mounting device affached to said frame, said second mounting device dimensioned and shaped to engage a second portion of said reflector.

31. The lighting system of claim 30 wherein said first reflector portion lies on one side of said opening and said second reflector portion lies on an opposite side of said opening.

32. The lighting system of claim 24 wherein the direction of light produced by said accent light is adjustable while said luminaire remains stationary.

33. The lighting system of claim 24 wherein light produced by said accent light is adjustable left and right and up and down with respect to said luminaire.

34. The lighting system of claim 24 wherein said reflector comprises a parabolic shape.

35. The lighting system of claim 24 wherein said reflector comprises a para-elliptical shape.

36. The lighting system of claim 24 wherein said luminaire provides downlighting.

37. The lighting system of claim 24 wherein light produced by said accent light and light produced by said luminaire are output such that they overlap.

38. A method of adding accent lighting to downlighting, said method comprising:

engaging a first mounting device of an accent light to a first portion of a luminaire, said luminaire directing light downward; and engaging a second mounting device of said accent light to a second portion of said luminaire; wherein:

said accent light is positioned laterally across said luminaire directly in front of a lamp of said luminaire;

said method further comprising, during said engaging, inserting a portion of at least one of the first and second mounting devices within the luminaire in an opening of said luminaire.

39. The method of claim 38 further comprising coupling power to said accent light.

40. The method of claim 38 wherein said downlighting comprises fluorescent lighting.

41. The method of claim 38 wherein said first and second portions of said luminaire comprise a reflector of said lummaire.

42. The method of claim 38 wherein said first and second portions of said luminaire comprise a housing of said luminaire.

43. The method of claim 38 wherein said first mounting device is a spring clip.

44. The method of claim 38 wherein said second mounting device is a clip.

45. The method of claim 38 wherein said engaging said first mounting device comprises forcing said first mounting device into a position adjoining said first luminaire portion.

46. The method of claim 38 wherein said engaging said second mounting device comprises inserting a portion of said second mounting device into a screwport of said luminaire.

47. The method of claim 38 wherein said engaging said second mounting device comprises fitting a portion of said second mounting device over said second luminaire portion.

48. The method of claim 38 wherein said second portion of said luminaire is laterally opposite said first portion of said luminaire.

49. A lighting system, comprising:

a luminaire including an opening through which the luminaire emits light from a linear lamp tube disposed within the opening;

a frame attached to the luminaire, wherein said frame extends at least partially across the opening of said luminaire; and a lampholder attached to said frame configured to receive a lamp for emitting light from the accent light;

wherein the frame and the lampholder extend across said opening and across and directly in front of the linear lamp tube disposed in the luminaire opening; and wherein at least a portion of the frame is disposed within the luminaire in the opening.

50. The accent light of claim 49, wherein said frame is attached to said luminaire via a first mounting device and a second mounting device.

51. The accent light of claim 50, wherein said first mounting device is dimensioned and shaped to directly engage a first portion of a luminaire and said second mounting device is dimensioned and shaped to directly engage a second portion of said luminaire disposed opposite from the first portion.

52. The accent light of claim 50, wherein said frame is rotatable about a first axis while said first and second mounting devices remain stationary.

53. The accent light of claim 50, wherein said frame is rotatable about a first axis aligned with said first and second mounting devices.

54. The accent light of claim 50, wherein said first mounting device is dimensioned and shaped to engage a first edge of a reflector of said luminaire.

* * * * *